US006158706A

United States Patent [19]

Johnson

[11] Patent Number: 6,158,706

[45] Date of Patent: Dec. 12, 2000

[54] METHOD OF PREVENTING SEPARATION OF A VERTICALLY ADJUSTABLE SUPPORT COLUMN HAVING SECTIONS CONNECTED TOGETHER BY MATING THREADS AND A VERTICALLY ADJUSTABLE SUPPORT COLUMN

[76] Inventor: Robert Johnson, 55-51308 Range Road 224, Sherwood Park, Alberta, Canada, T8C 1H3

[21] Appl. No.: 09/223,207

[22] Filed: Dec. 30, 1998

[30] Foreign Application Priority Data

Feb. 3, 1998 [CA] Canada ..... 2228666

[51] Int. Cl.[7] ..... A47F 5/00

[52] U.S. Cl. ..... 248/354.3; 248/188.4; 248/200.1

[58] Field of Search ..... 248/188.4, 188.5, 248/354.3, 354.4, 157, 159, 422, 423, 228.1, 228.3, 218.4, 219.1, 219.2, 200.1, 420; 52/126.6, 169.9; 403/343

[56] References Cited

U.S. PATENT DOCUMENTS

| | | | |
|---|---|---|---|
| 840,770 | 1/1907 | Ives . | |
| 1,796,173 | 3/1931 | Warren . | |
| 2,548,844 | 4/1951 | Myers | 254/98 |
| 2,686,649 | 8/1954 | Vigier | 248/354 |
| 3,398,933 | 8/1968 | Haroldson | 254/984 |
| 3,603,552 | 9/1971 | Wheelock | 248/354 |
| 4,122,645 | 10/1978 | Tooley | 52/648 |
| 4,948,207 | 8/1990 | Rolls et al. | 248/188.4 X |
| 5,398,466 | 3/1995 | Oyama et al. | 52/126.6 |
| 5,484,130 | 1/1996 | Domanski et al. | 248/354.3 |
| 5,515,655 | 5/1996 | Hoffmann | 52/126.6 |
| 5,564,867 | 10/1996 | Domanski et al. | 248/354.3 X |
| 5,588,264 | 12/1996 | Buzon | 52/126.6 |
| 5,590,494 | 1/1997 | Miller | 52/169.9 |
| 5,595,366 | 1/1997 | Cusimano et al. | 248/354.3 |
| 5,772,356 | 6/1998 | Collins | 403/343 |
| 5,881,979 | 3/1999 | Rozier, Jr. et al. | 248/188.5 |
| 5,967,702 | 10/1999 | Vogelzang | 405/290 |
| 6,024,330 | 2/2000 | Mroz et al. | 248/188.4 |

*Primary Examiner*—Ramon O. Ramirez
*Assistant Examiner*—Tan Le
*Attorney, Agent, or Firm*—Davis And Bujold

[57] ABSTRACT

A method of preventing separation of a vertically adjustable support column having sections connected together by mating threads and a support column. External threads of a second section are mated with internal threads of a first section until a first end of the second section protrudes into an enlarged diameter portion of an interior bore of the first section immediately adjacent to the internal threads. A top few of the external threads at the first end of the second section are mechanically damaged. The mechanically damaged threads prevent the first end of the second section from being removed from the enlarged diameter portion of the first section but permit relative telescopic adjustment of the first section and the second telescopic section within a limit provided by the enlarged diameter section.

10 Claims, 5 Drawing Sheets

METHOD OF PREVENTING SEPARATION OF A VERTICALLY ADJUSTABLE SUPPORT COLUMN HAVING SECTIONS CONNECTED TOGETHER BY MATING THREADS AND A VERTICALLY ADJUSTABLE SUPPORT COLUMN

FIELD OF THE INVENTION

The present invention relates to a method of preventing separation of a vertically adjustable support column having sections connected together by mating threads and a vertically adjustable support column constructed in accordance with the teachings of the method.

BACKGROUND OF THE INVENTION

There are a variety of support columns that have two or more sections that are connected together by mating threads. One example of such a support column is U.S. Pat. No. 2,548,844 which issued to Meyers in 1951. The Meyers reference has a support element the upper end of which is externally threaded. The support element mates with an internally threaded extension sleeve to which is attached a centering plate. Relative rotation of the support element and the extension sleeve permits some telescopic adjustment of the length of the support column. A more recent example of such a support column is U.S. Pat. No. 5,588,264 which issued to Buzon in 1996. The Buzon reference includes a base member that is rotatably engaged with a support member. The base member includes a threaded cylindrical bore that engages a threaded cylindrical projection on the support member. Relative rotation of the base member and the support member permits some telescopic adjustment of the length of the support column.

Several potential dangers are associated with support columns that have two or more sections connected together by mating threads. One danger is that over rotation will result in the separation of the sections. Another danger is that there may be failure if there is insufficient telescopic engagement. In view of this danger, some jurisdictions have passed laws making it mandatory that some means be provided to prevent the separation of the sections and ensure adequate telescopic engagement.

SUMMARY OF THE INVENTION

What is required is a method of preventing separation of sections of a support column connected together by mating threads.

According to one aspect of the present invention there is provided a method of preventing separation of a vertically adjustable support column having sections connected together by mating threads. A first step involves providing a first section having a first end, a second end and an interior surface defining an interior bore. The interior surface has internal threads at the second end and an enlarged diameter portion spaced from the second end immediately adjacent to the internal threads. A second step involves providing a second section having a first end, a second end and an exterior surface. The exterior surface has external threads at the first end capable of mating with the internal threads of the first section. A third step involves mating the external threads of the second section with the internal threads of the first section until the first end of the second section protrudes into the enlarged diameter portion of the interior bore of the first section. A fourth step involves mechanically damaging a top few of the external threads at the first end of the second section. The mechanically damaged threads prevent the first end of the second section from being removed from the enlarged diameter portion of the first section but permit relative telescopic adjustment of the first section and the second telescopic section within a limit provided by the enlarged diameter section.

When the threads on the external surface of the second section are mechanically damaged, they no longer mate with the internal threads of the first section. By following the teachings of the above described method, an inexpensive and yet very reliable stopper is created that prevents the separation of the first section and the second section. The preferred point of access to mechanically damage the threads is with a tool inserted into the interior bore from the first end of the first section.

Although beneficial results may be obtained through the use of the method, as described above, if great care is not taken in damaging the threads, the damaged threads can bear against the interior surface of the first section and cause friction which adversely affects ease of adjustment. Even more beneficial results may, therefore, be obtained when the first member has at least one aperture through the enlarged diameter portion of the interior bore spaced from the internal threads. This enables a further step to be taken, whenever friction adversely affects adjustability, of inserting a tool through the aperture to compact the damaged threads to prevent inner friction between excessively damaged threads and the interior surface of the first section.

It is preferred that several apertures be provided. This enables the apertures to serve a dual purpose. In addition to providing a means of access to repair excessive mechanical damage, the apertures provide a means of vertically adjusting the column. Vertical adjusting of the column can be performed by inserting screw drivers, or other tools into the openings and applying the appropriate torque to rotate the first section relative to the second section.

According to another aspect of the present invention, there is provided a vertically adjustable support column which includes a first section and a second section. The first section has a first end, a second end and an interior surface defining an interior bore. The interior surface has internal threads at the second end and an enlarged diameter portion spaced from the second end immediately adjacent to the internal threads. The second section has a first end, a second end and an exterior surface. The exterior surface has external threads at the first end mated with the internal threads of the first section with the first end of the second section protruding into the enlarged diameter portion of the first section. A top few of the external threads at the first end of the second section are mechanically damaged so that the mechanically damaged threads prevent the first end of the second section from being removed from the enlarged diameter portion of the first section but permit relative telescopic adjustment of the first section and the second section within a limit provided by the enlarged diameter section.

BRIEF DESCRIPTION OF THE DRAWINGS

These and other features of the invention will become more apparent from thy following description in which reference is made to the appended drawings, wherein.

DETAILED DESCRIPTION OF THE PREFERRED EMBODIMENT

The preferred method of preventing separation of a vertically adjustable support column having sections connected together by mating threads will now be described with reference to FIGS. 1 through 5.

Figure 1:
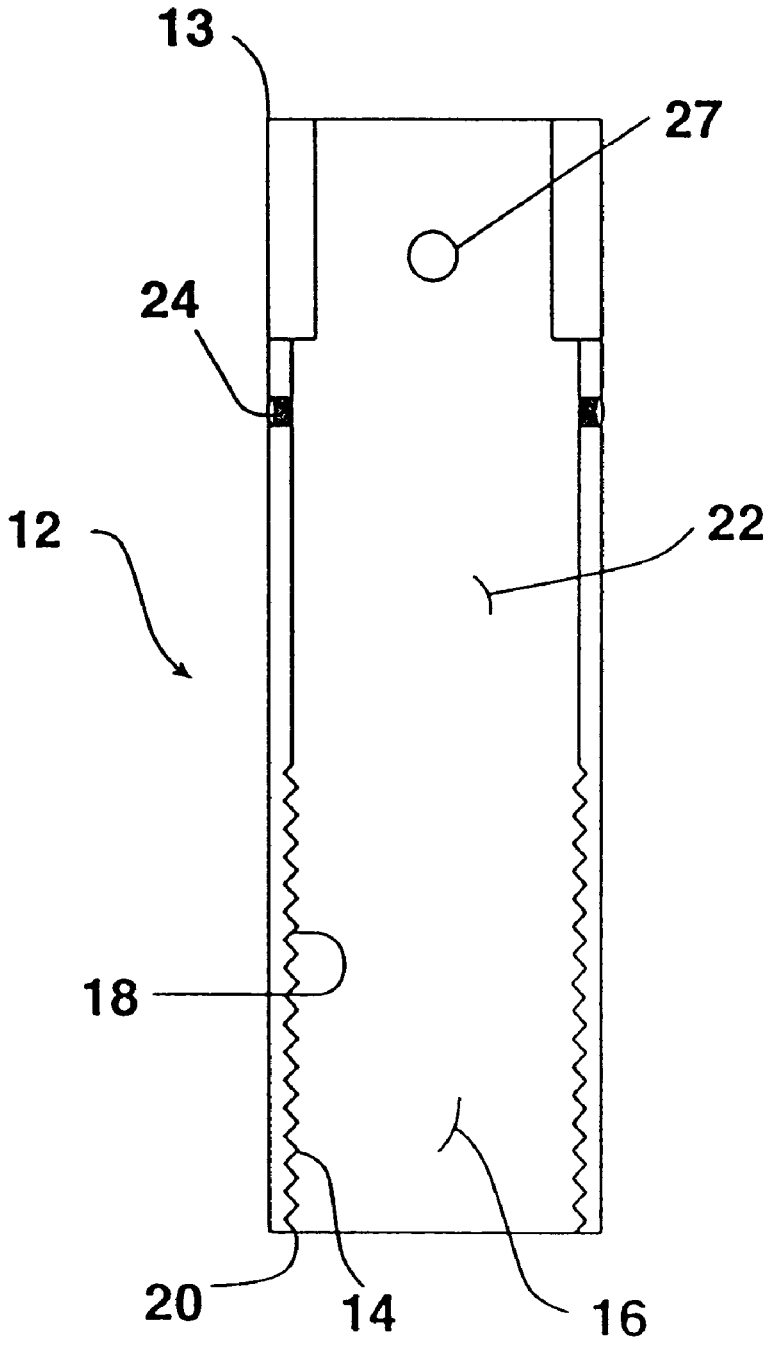
FIG. 1 is a side elevation view, in section, of a first or upper sections a support column constructed in accordance with the teachings of the present invention.

Referring to FIG. 1, a first step involves providing a first or upper section 12 having a first end 13, a second end 20 and an interior surface 14 defining an interior bore 16. Interior surface 14 has internal threads 18 at second end 20. Interior bore 16 has an enlarged diameter portion 22 adjacent internal threads 18. Several apertures 24 and 27 are provided through enlarged diameter portion 22 of interior bore 16 spaced from internal threads 18.

Figure 2:
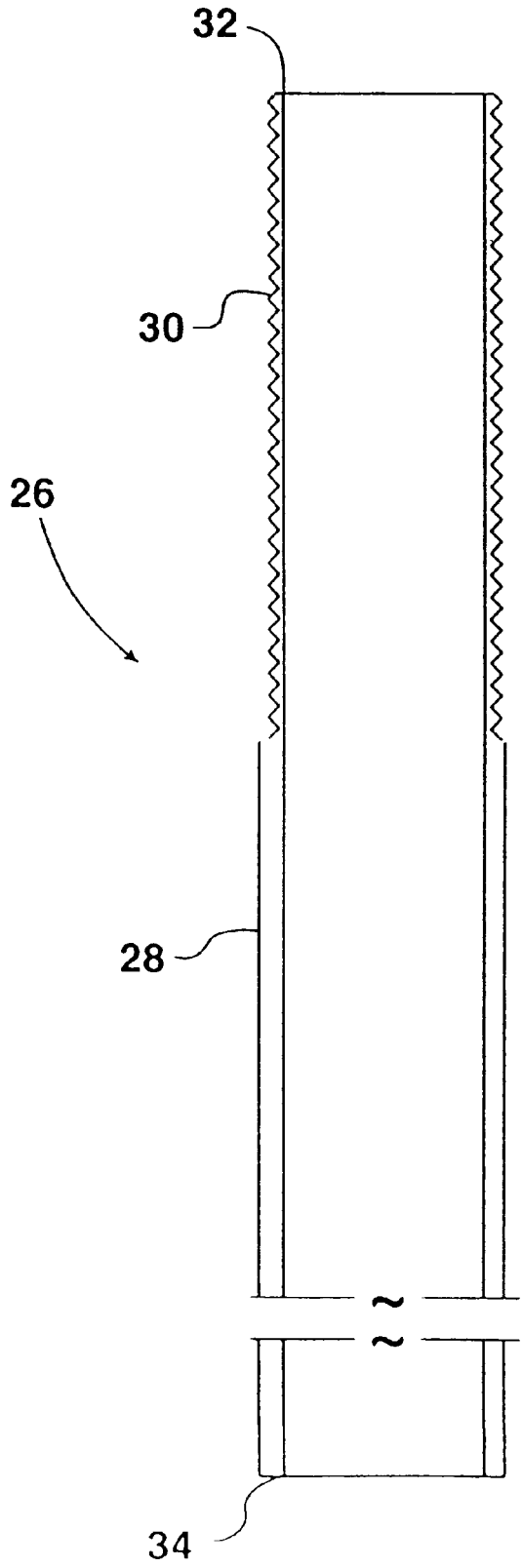
FIG. 2 is side elevation view, in section, of a second or lower section of a support column constructed in accordance with the teachings of the prevent invention.

Referring to FIG. 2, a second step involves providing a second or lower section 26 having a first end 32 and a second end 34 with an exterior surface 28 having external threads 30 at first end 32. External threads 30 must be capable of mating with internal threads 18 of first section 12. There are a greater number of external threads 30 than internal threads 18, such that when second section 26 is fully engaged with first second 12 external threads 30 extend into enlarged diameter portion 22 of interior bore 16 of first or upper section 12, as will hereinafter be further described.

Figure 3:
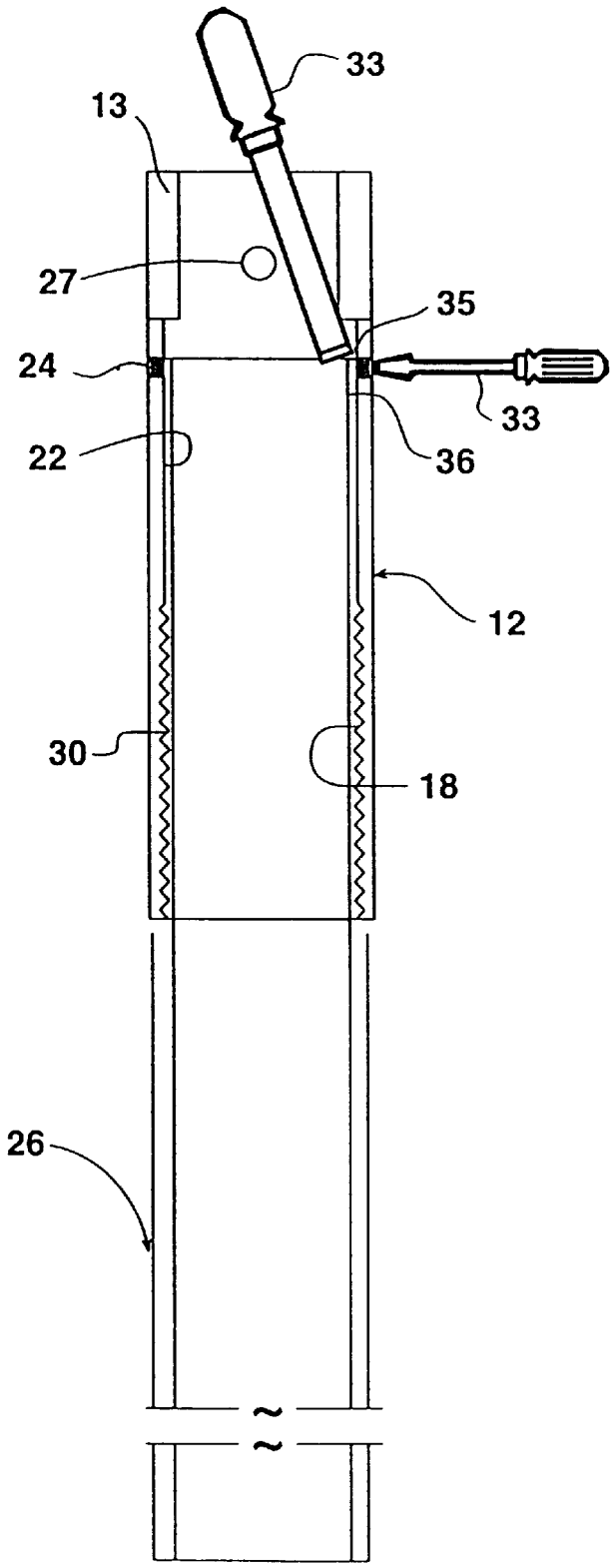
FIG. 3 is a side elevation view, in section, of a support column constructed in accordance with the teachings of the present invention, in the process of a stopper being formed to prevent the separation of the first or upper section illustrated in FIG. 1 and the second or lower section illustrated in FIG. 2.

Referring to FIG. 3, a third step involves mating external threads 30 of second or lower section 26 with internal threads 18 of first or upper section 12 until first end 32 of second section 26 protrudes into enlarged diameter portion 22 of interior bore 16 of first or upper section 12.

Figure 4:
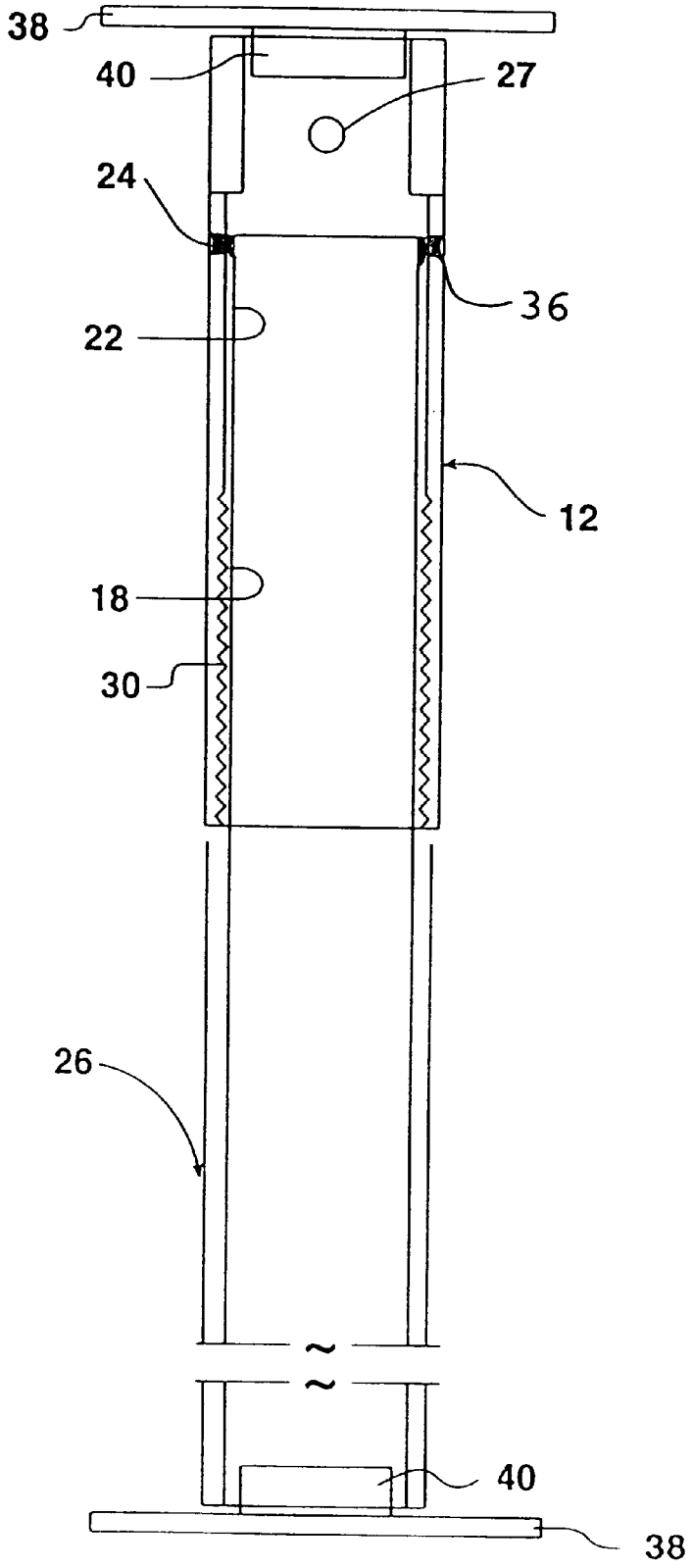
FIG. 4 is side elevation view, in section, of a support column constructed in accordance with the teachings of the resent invention in a fully retracted position.
Figure 5:
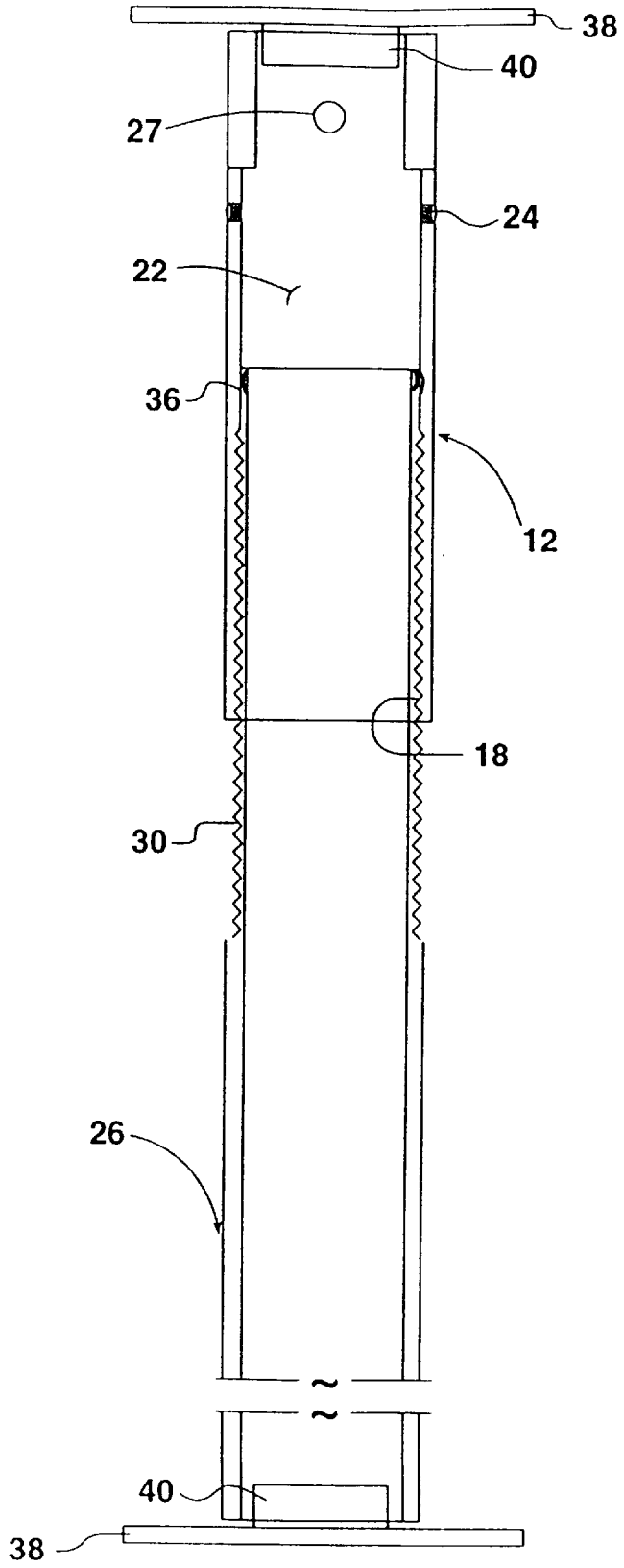
FIG. 5 is a side elevation view, in section, of a support column constructed in accordance with the teachings of the present invention in a fully extended position.

A fourth step involves inserting a tool 33, such as a chisel or screwdriver, through either first end 13 of first or upper section 12 or one of apertures 24 or 27 to mechanically damage exposed external threads 30 of second or lower section 26. Once external threads 30 have been mechanically damaged, first end 32 of second or lower section 26 can no longer be removed from enlarged diameter portion 22 of first or upper section 12. Referring to FIGS. 4 and 5, mechanically damaged external threads are generally indicated by reference numeral 36. It will be noted that mechanically damaged external threads 36 provide a stop that prevents second or lower section 26 from being removed from first section 12, while still enabling telescopic adjustment throughout the limits set by enlarged diameter portion 22 of first or upper section 12.

Referring to FIG. 3, a further step should be taken if damaged threads 36 bear against interior surface 14 of first or upper section 12 and cause friction which adversely affects the ease of adjustment. A tool 33 is inserted through one of apertures 24 or 27 to compact damaged threads 36 to prevent such friction.

By following the teachings of the above described method, a support column, generally identified by reference numeral 10, can be fabricated that has an inexpensive and yet very reliable stopper that prevents the separation of first or upper section 12 and second or lower section 26. The preferred embodiment of support column 10 will now be described in greater detail.

Referring to FIG. 2, external threads 30 of second or lower column section 26 have a pitch of 12 male threads per inch and occupies 7½ inches of its length at top end 32. The outer diameter of second or lower column section 26 is 2⅞ inches.

Referring to FIG. 1, internal threads 18 of first or upper column section 12 has a pitch of 12 female threads per inch and occupies 4¼ inches of its length at bottom end 20. Enlarged diameter section 22 of interior bore 16 extends for 3¾ inches above internal threads 18. Above enlarged diameter section 22. There are several apertures 24 and 27 that are positioned in enlarged diameter section 22 of interior bore 16. At least two apertures 24 should be provided which are offset by 180 degrees, as this configuration makes it easier to apply torque as will hereinafter be further described. There may be further advantages to having an additional pair of apertures 27, to provide better access in confined spaces. A preferred diameter for apertures 24 and 27 is 11/16 of an inch, as this has been found to permit insertion of a screw driver or pry bar to apply torque. The outer diameter of first or upper section is 3 inches. Internal threads 18 are standard API box threads. Enlarged diameter section 22 is bored such that its inner diameter is an additional 5 thousandth of an inch greater than the major diameter of internal threads 18. The overall length of first or upper section 12 is 10 inches.

Referring to FIGS. 4 and 5, first or upper section 12 screws on to second or lower section 26 to form continuous support column 10. Apertures 24 and 27 in first or upper section 12 provide a means for applying torque in screwing first or upper section 12 up or down to adjust the height. FIG. 4 shows support column 10 in its fully retracted state. When support column 10 is fully retracted, 2 to 3 threads at top end 32 of second or lower section 26 show through apertures 24. Referring to FIG. 3, these exposed male threads are scored or damaged in accordance with the teachings of the method to create a stopper. Referring to FIG. 5 shows support column 10 in its fully extended state. Because the top 2 or 3 male threads are scored or damaged, when support column 10 is first in its fully retracted position, support column 10 can only be extended to the point where mechanically damaged external threads 36 encounter internal threads 18. This ensures that there is a minimum telescopic overlap of the two sections of 4¼ inches, which is the length of internal threads 18.

Care must be taken when damaging external threads 30, as excessive damage causes friction. Care must be taken in the positioning of apertures 24. If apertures 24 are positioned above the positioning of second or lower section 26, it becomes impossible to reach external threads 30 with tool 33 in order to fix excessive mechanical damage to external threads 30 that are causing friction. It is preferred that only the first two or three external threads 30 be damaged. This allows a telescopic adjustment of approximately 3 inches. Referring to FIGS. 4 and 5, it is preferred that removable bearing plates 38 be provided at opposite ends of support column 10. Each bearing plate 38 is provided with a centering stud 40 that is 1 inch in height to prevent relative lateral movement of support column 10 and bearing plate 38. Centering stud 40 assists in preventing bearing plate 38 from separating from or falling off column 10 as column 10 is erected. By removing bearing plate 38, support column 10 can be trimmed as required to suit a particular application.

Differing styles of bearing plate 38 are used to suit different installation requires.

It will be apparent to one skilled in the art that the length of external threads 30 and enlarged diameter portion 22 must be selected to maintain the relationship described above. It will also be apparent to one skilled in the art that modifications may be made to the illustrated embodiment without departing from the spirit and scope of the invention as hereinafter defined in the Claims.

The embodiment of the invention in which an exclusive property of privilege is claimed are defined as follows:

1. A method of preventing separation of a vertically adjustable support column having sections connected together by mating threads, comprising the steps of:

providing a first section having a first end, a second end and an interior surface defining an interior bore, the interior surface having internal threads at the second end and an enlarged diameter portion spaced from the second end immediately adjacent to the internal threads;

providing a second section having a first end, a second end and an exterior surface having external threads at the first end capable of mating with the internal threads of the first section;

mating the external threads of the second section with the internal threads of the first section until the first end of the second section protrudes into the enlarged diameter portion of the interior bore of the first section; and mechanically damaging with a tool a top few of the external threads at the first end of the second section so that the mechanically damaged threads prevent the first end of the second section from being removed from the enlarged diameter portion of the first section but permit relative telescopic adjustment of the first section and the second telescopic section within a limit provided by the enlarged diameter section.

2. A method of preventing separation of a vertically adjustable support column having sections connected together by mating threads, comprising the steps of:

providing a first section having a first end, a second end and an interior surface defining an interior bore, the interior surface having internal threads at the second end and an enlarged diameter portion spaced from the second end immediately adjacent to the internal threads;

providing a second section having a first end, a second end and an exterior surface having external threads at the first end capable of mating with the internal threads of the first section;

mating the external threads of the second section with the internal threads of the first section until the first end of the second section protrudes into the enlarged diameter portion of the interior bore of the first section; and engaging a tool with external threads at the first end of the second section and damaging the external threads at the first end of the second section to prevent the second section from being removed from the enlarged diameter portion of the first section but permit relative telescopic adjustment of the first section and the second telescopic section within a limit provided by the enlarged diameter section.

3. The method as defined in claim 2, the external threads being damaged by inserting the tool through the first end of the first section to mechanically damage a top few of the external threads at the first end of the second section.

4. The method as defined in claim 2, the first member having at least one aperture through the enlarged diameter portion of the interior bore spaced from the internal threads, the external threads being damaged by inserting the tool through the at least one aperture to mechanically damage a top few of the external threads at the first end of the second section.

5. The method as defined in claim 2, the first member having at least one aperture through the enlarged diameter portion of the interior bore spaced from the internal threads, and including a further step of inserting the tool through the at least one aperture to compact the damaged threads to prevent inner friction between excessively damaged threads and the interior surface of the first section.

6. A vertically adjustable support column, comprising:

a first section having a first end, a second end and an interior surface defining an interior bore, the interior surface having internal threads at the second end and an enlarged diameter portion spaced from the second end immediately adjacent to the internal threads;

a second section having a first end, a second end and an exterior surface having external threads at the first end mated with the internal threads of the first section with the first end of the second section protruding into the enlarged diameter portion of the first section; and a top few of the external threads at the first end of the second section being mechanically damaged, by engaging a tool with the external threads, so that the mechanically damaged threads prevent the first end of the second section from being removed from the enlarged diameter portion of the first section but permit relative telescopic adjustment of the first section and the second telescopic section within a limit provided by the enlarged diameter section.

7. The vertically adjustable support column as defined in claim 6, wherein a removable bearing plate is provided at the first end of the first section.

8. The vertically adjustable support column as defined in claim 6, wherein a removable bearing plate is provided at the second end of the second section.

9. The vertically adjustable support column as defined in claim 7, wherein the removable bearing plate has a centering stud.

10. The method as claimed in claim 2, wherein the step of engaging the tool with the external threads, at the first end of the second section, occurs following initial assembly of the vertically adjustable support column.

* * * * *